US006059020A

United States Patent [19]

Jairazbhoy et al.

[11] Patent Number: 6,059,020

[45] **Date of Patent: *May 9, 2000**

[54] APPARATUS FOR ACOUSTIC COOLING AUTOMOTIVE ELECTRONICS

[75] Inventors: Vivek Amir Jairazbhoy; Prathap Amerwai Reddy, both of Farmington Hills; George Mozurkewich, Jr., Plymouth, all of Mich.

[73] Assignee: Ford Global Technologies, Inc., Dearborn, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 08/784,883

[22] Filed: Jan. 16, 1997

[51] Int. Cl.[7] ..... F28D 11/06

[52] U.S. Cl. ..... 165/84; 62/6; 60/520; 361/688

[58] Field of Search ..... 165/84; 62/6; 60/520; 361/688

[56] References Cited

U.S. PATENT DOCUMENTS

| | | | |
|---|---|---|---|
| 4,489,553 | 12/1984 | Wheatley et al. | 60/516 |
| 4,553,917 | 11/1985 | Lee | 425/6 |
| 4,722,201 | 2/1988 | Hofler et al. | 62/6 |
| 4,858,441 | 8/1989 | Wheatley et al. | 62/6 |
| 4,858,717 | 8/1989 | Trinh et al. | 181/0.5 |
| 4,953,366 | 9/1990 | Swift et al. | 62/5 |
| 5,174,130 | 12/1992 | Lucas | 62/498 |
| 5,263,241 | 11/1993 | Hart, Jr. et al. | 29/827 |
| 5,282,637 | 2/1994 | McCreadie | 296/205 |
| 5,303,555 | 4/1994 | Chrysler et al. | 62/6 |
| 5,357,757 | 10/1994 | Lucas | 62/6 |
| 5,511,044 | 4/1996 | Bushman | 367/191 |
| 5,647,216 | 7/1997 | Garrett | 62/6 |
| 5,857,340 | 1/1999 | Garrett | 62/6 |

OTHER PUBLICATIONS

"The Influence of Heat Conduction of Acoustic Streaming", by N. Rott, Journal of Applied Mathematics & Phyusics, vol. 25, 1974, pp. 417–421.

"Heat Transfer From A Cylinder In An Acoustic Standing Wave", by George Mozurkewich, J. Acoust. Soc. Am. 98 (4), Oct. 1995, pp. 2209–2216.

Mason, Physical Acoustics, Principles and Methods, vol. II, Part B, Properties of Polymers and Nonlinear Acoustics, 1965, Chapter 11, Acoustic Streaming.

"Acoustic Streaming", by Sir James Lighthill, Journal of Sound and Vibration (1978) 61(3), 391–418.

"Thermoacoustic Engines", by G.W. Swift, J. Acoust. Soc. Am. 84(4), Oct. 1988, p. 1145.

"Thermoacoustic Engines And Refrigerators", by G.W. Swift, Physics Today, Jul. 1995, Thermoacoustics, pp. 22–28.

*Primary Examiner*—Ira S. Lazarus
*Assistant Examiner*—Terrell McKinnon
*Attorney, Agent, or Firm*—Leslie C. Hodges; Roger L. May

[57] ABSTRACT

An apparatus for acoustically cooling automotive electronics in which an acoustic driver and acoustic reflector are disposed within a hollow member, such as a cross-car-beam of a vehicle. The frequency of the acoustic driver and the distance between the acoustic driver and the acoustic reflector are selected to generate a standing acoustic wave within the hollow member. The standing acoustic wave will generate a fluid flow providing forced air convection cooling of a base or its extension on which

15 Claims, 3 Drawing Sheets

APPARATUS FOR ACOUSTIC COOLING AUTOMOTIVE ELECTRONICS

TECHNICAL FIELD

This invention is related to cooling and, in particular, to an apparatus for acoustic cooling automotive electronics.

BACKGROUND ART

Current technology for cooling electronics or other heat generating devices uses various combinations of heat transport mechanisms. Such heat transport mechanisms include but are not limited to conduction, convection and radiation. In many cases, the use of conduction, convention, or radiation alone are incapable of dissipating the heat generated by the objects. Further, the use of blowers or fans to generate forced convention cooling produces low frequency vibrations which are difficult to damp.

The use of acoustic waves to produce a forced convective air flow which can be used to cool a device is taught by the prior art. For example, Trinh et al is U.S. Pat. No. 4,858,717, discloses the use of a standing acoustic wave to cool a specific component on an electronic circuit board which requires more cooling than the other components. In a corresponding manner, Lee in U.S. Pat. No. 4,553,917 teaches the use of a standing acoustic wave for the cooling of ultra pure amorphous metals.

The invention is an apparatus for acoustic cooling using a hollow member.

SUMMARY OF THE INVENTION

The invention is an apparatus for cooling and, in particular, the cooling of automotive electronics using acoustic cooling. The apparatus has a base or support structure on which the automotive electronics may be mounted. The base is mounted in intimate thermal contact with a hollow member. An acoustic driver and acoustic reflector are mounted inside the hollow member which produce a standing acoustic wave. The acoustic wave generates an air flow within the hollow member which transports by forced air convection, the heat imparted to one region of the hollow member by the base to remote regions of the hollow member. This forced air convection cools the base and the automotive electronics attached thereto.

In a preferred embodiment, the base has a dependent member which extends into the interior of the hollow member between the acoustic driver and the acoustic reflector. Longitudinal cooling fins attached to the dependent member facilitate the dissipation of the heat imparted to the base.

One object of the invention is to cool the automotive electronics using a standing acoustic wave.

Another object of the invention is to force air cool the automotive electronics without using fans or blowers which produce low frequency vibrations which are difficult to damp.

Another object of the invention is an apparatus which produces a well-defined air flow pattern and hence focused cooling.

Still another object of the invention is an apparatus which is compact and can be embodied within unused space in the vehicle.

Yet another object of the invention is a cooling apparatus suited for the interior of a structural member of an automotive vehicle.

These and other objects will become more apparent from a detailed reading of the specification in conjunction with the appended drawings.

BEST MODE FOR CARRYING OUT THE INVENTION

Figure 1:
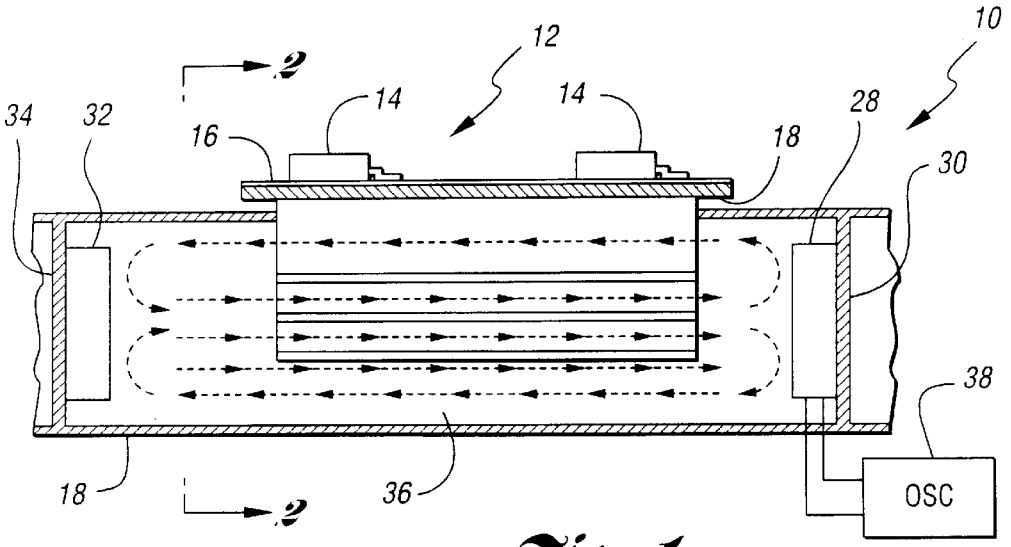
FIG. 1 is a cross-sectional view of a preferred embodiment of the invention.
Figure 2:
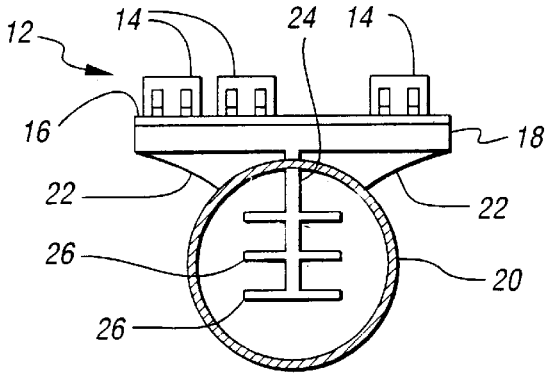
FIG. 2 is a cross-sectional view of the embodiment of FIG. 1 taken along section line 2—2.

A preferred embodiment of the apparatus 10 for acoustic cooling is shown in FIGS. 1 and 2. In the illustrated embodiment, the acoustic cooling apparatus is being used to cool an automotive electronic module 12. The automotive electronics module 12 consists of electronic components 14 mounted on the circuit board 16 which in turn is mounted on and in physical contact with a thermally conductive base 18. The base 18 is mounted on and in intimate thermal contact with a hollow member 20 of the automotive vehicle such as a cross-car-beam located under the dashboard within the passenger compartment of the automotive vehicle. The hollow member 20 preferably has a cylindrical configuration as shown in FIG. 2 but may have any other geometrical cross-sectional shape. The lower surface of the base 18 may be contoured to mate with the external surface of the hollow member 20. The base 18 has a dependent portion 24 which extends into the interior of the hollow member 20 as shown in FIG. 2. The dependent portion 24 preferably has a plurality of longitudinal cooling fins 26 extending therefrom within the interior of the hollow member.

An acoustic driver 28 is attached to a first bulkhead 30 within the hollow member 20 adjacent to one end of the dependent portion 24 and an acoustic reflector 32 is attached to a second bulkhead 34 adjacent the opposite end of the dependent portion 24. The region within the hollow member between the acoustic driver 28 and the acoustic reflector 32 defines an acoustic chamber 36.

Figure 7:
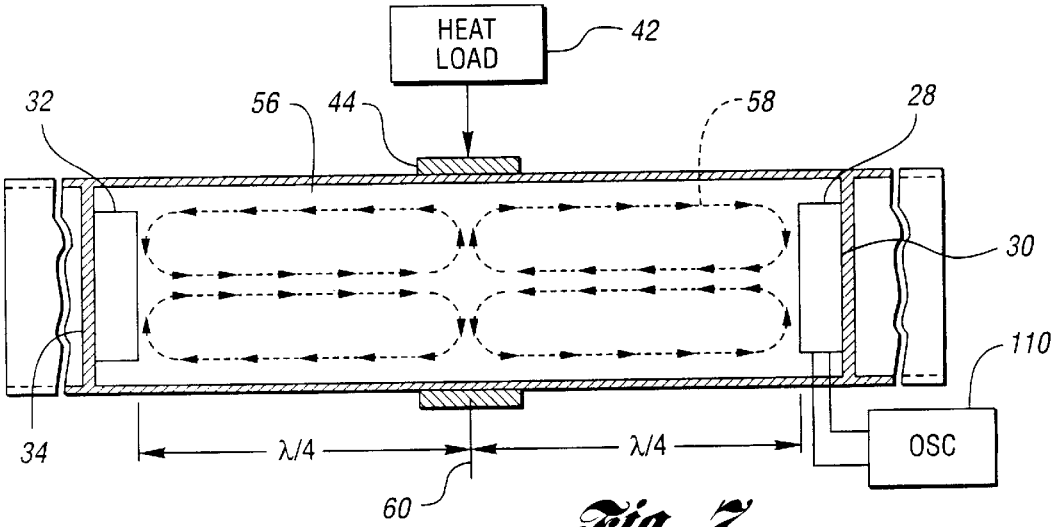
FIG. 7 is a cross-sectional view of a third embodiment of the invention.

An oscillator circuit 38 generates an oscillating electric signal applied to the acoustic driver 28 causing it to generate an acoustic wave within the acoustic chamber 36. The frequency of the generated acoustic wave and the distance between the acoustic driver 28 and the acoustic reflector 32 are selected to produce an intense standing acoustic wave inside the acoustic chamber 36. In the illustrated embodiment, the distance between the acoustic driver 28 and the acoustic reflector 32 is equal to one-fourth ($\lambda/4$) of the wavelength of the standing acoustic wave but may be equal to one-half ($\lambda/2$) of the wavelength of the standing acoustic wave as shown in FIG. 7 or any integral multiplier of a quarter wave length. The use of multiple quarter wave length spacings between the acoustic driver and the acoustic receiver facilitates the use of higher acoustic frequencies.

As is known in the art, an intense or large amplitude standing acoustic wave will produce a circulating air flow within the acoustic chamber between the acoustic driver 28 and the acoustic reflector 32 as indicated by arrows 40. The acoustic wave produces an axial air flow through the acoustic chamber from the acoustic reflector towards the acoustic driver 28, then radially outward across the face of the acoustic driver, then back to the acoustic reflector 28 along the internal surface of the hollow member 20. This air flow will then flow radially inwardly across the face of the acoustic reflector 32 then axially back to the acoustic driver 28.

The axial air flow from the acoustic reflector 32 to the acoustic driver 28 will pass between the cooling fins 26 and the heat generated by the automotive electronics module 12 will be transported to the air flowing therebetween. The heated air will then be transported by forced convection to a remote location of the hollow member 20 which functions as a heat sink.

Figure 3:
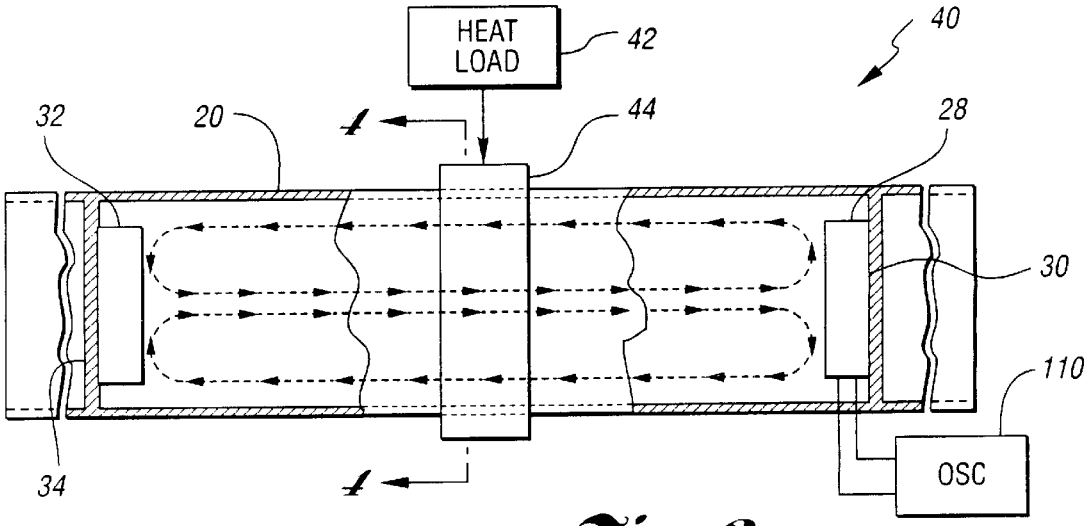
FIG. 3 is a cross-sectional view of a first alternate embodiment of the invention.
Figure 4:
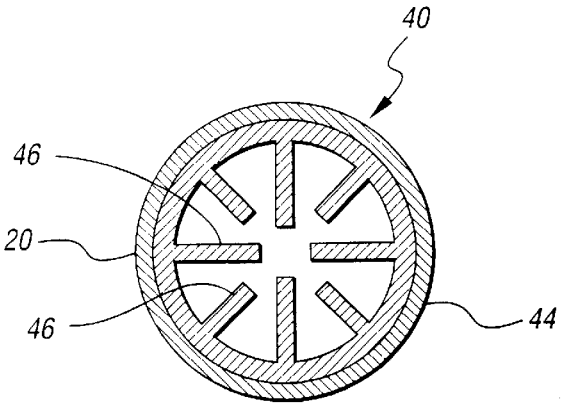
FIG. 4 is a cross-sectional view of the embodiment shown on FIG. 3 taken along section line 4—4.
Figure 5:
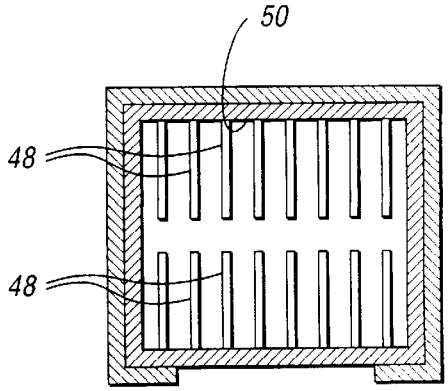
FIG. 5 is a cross-sectional view of a embodiment shown in FIG. 3 having a rectangular hollow member.

In an alternate embodiment 40 shown in FIG. 3 the heat from a heat load 42, such as the automotive electronics module 12 or any other object to be cooled is transported to a heat transport member 44 in thermal contact with the external surface of the hollow tube 20 at a location intermediate the acoustic driver 28 and the acoustic reflector 32. The heat transport member 44 transports the heat energy to the hollow member in the immediate vicinity thereof. The spacing between the acoustic driver 28 and the acoustic reflector 32 and the frequency of the generated acoustic wave are selected to produce a standing quarter wave length acoustic wave. A set of radial fins 46 as shown in FIG. 4 may be attached to the internal surface of circular hollow member 20 directly beneath heat transfer member 44. FIG. 5 shows an alternate arrangement of fins 48 in a rectangular hollow member 50.

The heat transport member 44 may completely surround the hollow member as shown in FIG. 4 or surround a major portion of the hollow member as shown in FIG. 5. In the alternative, the heat transport member 44 may be one or more windings of a coolant tube in which a coolant fluid is circulated to carry the heat energy generated by the heat load 42 to the desired region of the hollow member.

Figure 6:
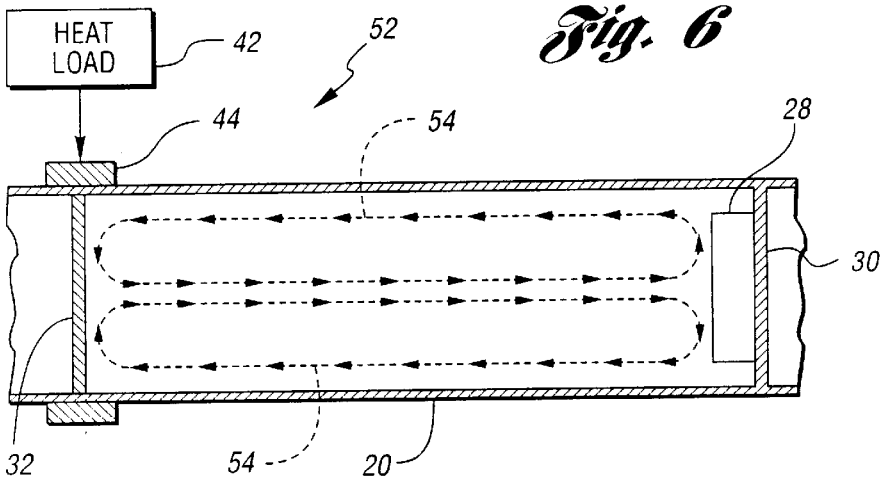
FIG. 6 is a cross-sectional view of an alternate embodiment of the invention.

FIG. 6 shows still another embodiment 52 of the acoustic cooling apparatus. In this embodiment, the acoustic reflector.32 is highly conductive and the heat transfer member 44 is thermally attached to the hollow member 20 in the immediate vicinity of the acoustic reflector 32. In this embodiment, heat energy from the heat load 42 is transported by the heat transport member 44 to the acoustic reflector 32. The heat energy is then transferred by forced air convection from the acoustic reflector 32 to a remote location of the hollow member 20 by the fluid circulation within the acoustic chamber 48 by the standing acoustic wave. The path of the circulating fluid is indicated by arrows 54.

The invention is not limited to acoustic chambers in which the spacing between the acoustic driver and the acoustic reflector are separated by a quarter ($\lambda/4$) wave length. As shown in FIG. 7, the acoustic driver 28 and the acoustic reflector 32 are separated by a half ($\lambda/2$) wave length or any other distance which is a multiple of a quarter wave length. In the embodiment shown in FIG. 7, two fluid circulation loops 56 and 58 are formed on opposite sides of the pressure node 60 of the generated acoustic wave. A heat transport member 44 is disposed at the location of the pressure node 60 to transport heat energy from the heat load 42 to the hollow member 20. The heat transported to the hollow member is transported to a remote location by forced convection. Fins such as fins 46 or 48 shown on FIGS. 4 and 5, respectively, may be attached to the internal surface of the hollow member to facilitate the transport of the heat energy from the heat load 42 to the circulating fluid within the hollow member 20. The heated fluid then transports the heat energy to the hollow member 20 at a location remote from the heat transport member 44.

Figure 8:
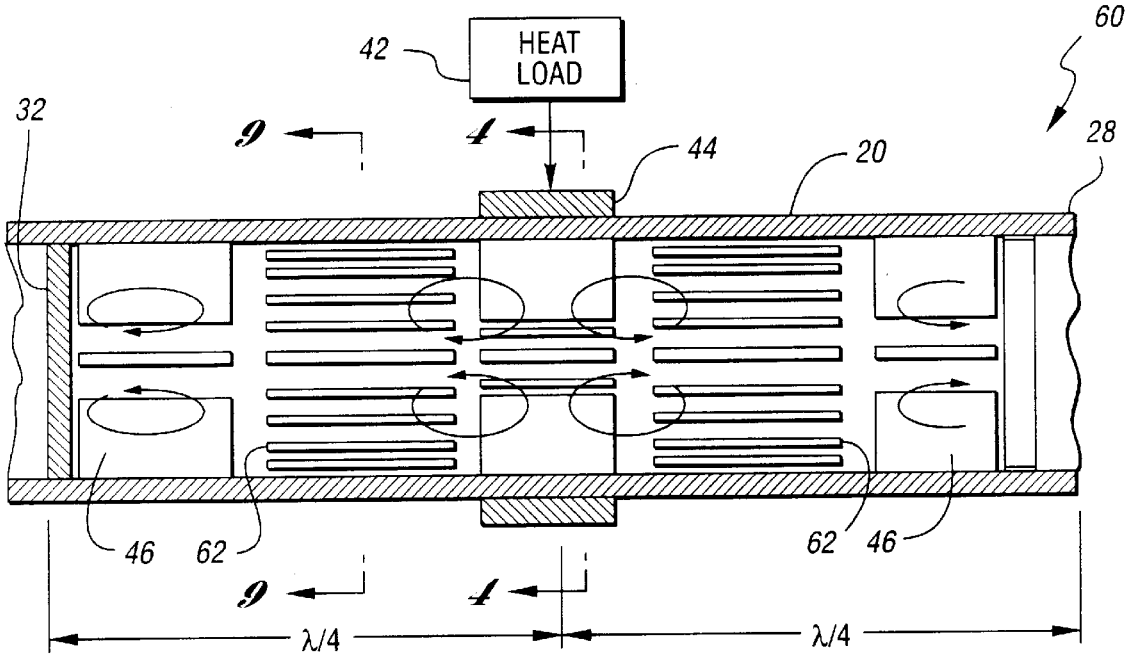
FIG. 8 is a cross-sectional view of a thermoacoustic embodiment of the invention.
Figure 9:
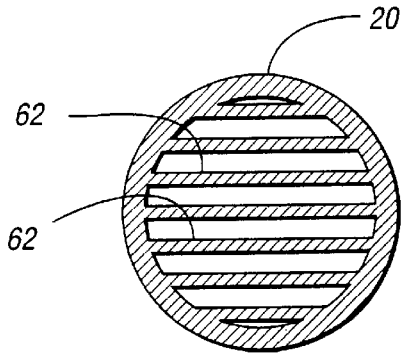
FIG. 9 is a cross-section of FIG. 8 taken along section line 9—9.

A thermoacoustic embodiment of an apparatus for acoustic cooling is shown in FIGS. 8 and 9. A thermally conductive heat transport member 44 is attached to the hollow member 20 intermediate the acoustic driver 28 and the acoustic reflector 32 spaced from each other by a distance substantially equal to a half wave length ($\lambda/2$) of a standing acoustic wave. A set of radial cooling fins such as cooling fins 46 shown in FIG. 4 may be provided inside of the hollow member 20 at a location corresponding to the location of the pressure node of the generated acoustic wave which occurs approximately half way between the acoustic driver and reflector, i.e., a quarter wave length ($\lambda/4$) from the acoustic driver 28 and the acoustic reflector 32, respectively. The hollow member 20 is engaged by the heat transport member 44 in this same location. A like set of fins 46 may also be provided adjacent both the acoustic driver 28 and the acoustic reflector 32 as shown in FIG. 8. The fins 46 enhance transporting the heat away from the pressure node and to the pressure antinode portion of the hollow member. However, for some conditions requiring less heat transport, these fins may be omitted.

Intermediate the pressure node and the pressure antinodes of the standing acoustic wave, there is provided a stack of closely spaced thermo-acoustic plates 62.

The operating principle is that a parcel of gas in an acoustic standing wave moves in opposite directions during the compression (heating) and expansion (cooling) phases of the acoustic wave cycle thereby transporting heat energy away from the pressure node towards a pressure antinode. The heat energy emitted from the pressure node region of the hollow member is transported to the end of the stacked plates 62 nearest the pressure node, and is thermoacoustically transported through by the stacked plates 62 to the end adjacent to the acoustic driver and the acoustic reflector, respectively. This heat energy is then collected by and transported by the fins 46 to the hollow member 20 at a remote location which acts as a heat sink. In this embodiment, the stacked plates 62 act as a porous medium which thermoacoustically transports the heat energy from the pressure node region of the standing acoustic wave to the antinode regions.

Although the embodiment shown in FIG. 8 has two stacks of plates 62 on opposite sides of the pressure node of the acoustic wave, for small heat loads, one of the stacks of plates may be omitted and the separation between the acoustic driver and acoustic reflector may be a quarter wave length or any multiple thereof.

The heat transport of the thermoacoustic embodiment shown in FIG. 8 as well as the acoustic cooling embodiments shown on FIGS. 1 through 7 can be enhanced by pressurizing the fluid being circulated by the standing acoustic wave.

While the best mode and viable alternate embodiments for carrying out the invention have been described in detail and shown in the drawings, those familiar in the art to which this invention relates will recognize various alternative designs and embodiments for practicing the invention as defined by the following claims.

What is claimed is:

1. An apparatus for acoustic cooling an external heat load comprising:

a hollow member;

a fluid filling said hollow member;

a heat transport member connected between the external heat load and the hollow member, said heat transport member being in intimate thermal contact with said hollow member;

an acoustic wave generator operative to generate an acoustic wave in said hollow member at a predetermined frequency; and an acoustic reflector disposed in said hollow member at a location selected to reflect said acoustic wave to produce a standing acoustic wave at a location adjacent to said heat transport member, said standing acoustic wave inducing a circulating flow of said fluid inside the hollow member transporting, by forced convection, the heat energy transported to said hollow member by the heat transport member to a remote location of hollow member acting as a heat sink.

2. The apparatus of claim 1 wherein said acoustic wave generator comprises:

an acoustic driver disposed in said hollow member operative to produce an acoustic wave in response to an input electrical signal; and an oscillator for generating said electrical signal.

3. The apparatus of claim 1 wherein said acoustic reflector is highly conductive and said heat transport member is thermally attached to the hollow member in the immediate vicinity of said acoustic reflector.

4. The apparatus of claim 1 wherein said heat transport member has a dependent portion extending into the interior of said hollow member.

5. The apparatus of claim 4 wherein said dependent portion has longitudinal cooling fins facilitating the transfer of heat energy from said heat transport member to said circulating flow of said fluid.

6. The apparatus of claim 1 wherein said hollow member is a cross-car-beam of an automotive vehicle and said heat load is an automotive electronics module.

7. The apparatus of claim 1 wherein said standing acoustic wave has a pressure node and at least one pressure antinode, said apparatus further comprising:

at least one porous member disposed between said pressure node and said at least one pressure antinode.

8. The apparatus of claim 7 wherein said standing wave has a pressure antinode on opposite sides of said pressure node, said apparatus has a porous member disposed between said pressure node and each of said pressure antinodes.

9. The apparatus of claim 8 wherein said heat transport member is in intimate contact with an external surface of the hollow member in the immediate vicinity of said pressure node.

10. The apparatus of claim 8 wherein each of said porous members is a set of closely stacked plates.

11. The apparatus of claim 8 further including a set of fins disposed inside said hollow member in the regions adjacent said pressure node and said pressure antinodes of said standing acoustic wave.

12. The apparatus of claim 11 wherein said sets of fins are radially disposed inside said hollow member.

13. The apparatus of claim 8 wherein the fluid inside said hollow member is pressurized.

14. The apparatus of claim 1 wherein said hollow member is a cross-car-beam provided within the passenger compartment of the vehicle.

15. The apparatus of claim 6 wherein said automotive cross-car-beam is located within the passenger compartment of an automotive vehicle.

* * * * *